United States Patent [19]

Hunter

[11] Patent Number: 4,582,015

[45] Date of Patent: Apr. 15, 1986

[54] WATER SKI RACK

[76] Inventor: James A. Hunter, 14375 SW. 20th, Beaverton, Oreg. 97005

[21] Appl. No.: 653,672

[22] Filed: Sep. 21, 1984

[51] Int. Cl.[4] ..... B63B 17/00

[52] U.S. Cl. ..... 114/343; 114/364; 211/70.5; 224/42.45 R; 224/917

[58] Field of Search ..... 114/343, 364, 362; 440/104, 109; 441/79; 211/70.5, 70.8; 224/42.45 R, 917, 42.07

[56] References Cited

U.S. PATENT DOCUMENTS

| | | | |
|---|---|---|---|
| 1,185,178 | 5/1916 | Cella | 440/109 |
| 3,291,427 | 12/1966 | Hutchings | 224/42.45 R |
| 3,564,632 | 2/1971 | Bahne, Jr. | 441/79 |
| 3,776,437 | 12/1973 | Carney | 224/42.45 R |
| 3,811,143 | 5/1974 | Page | 114/364 |
| 3,925,836 | 12/1975 | Simmonds | 114/364 |
| 4,232,806 | 11/1980 | Shald | 224/42.44 |
| 4,234,112 | 11/1980 | Gallant | 224/42.43 |

*Primary Examiner*—Sherman D. Basinger

*Attorney, Agent, or Firm*—Chernoff, Vilhauer, McClung, Birdwell & Stenzel

[57] ABSTRACT

A ski rack for supporting water skis in a position outboard one side of a water ski tow boat. A pair of support members are held in sockets which can be clamped to portions of the hull of the boat on the inboard side of the gunwale. Arms which are part of the support members extend at a downward slope outside the hull of the boat, and pairs of fingers which are coated with a protective plastic layer extend upwardly generally vertically from the arms, to hold water skis securely between the fingers, out of the way of passengers in the boat and out of the line of sight between the operator of the boat and a water skier being towed.

7 Claims, 5 Drawing Figures

FIG. 1
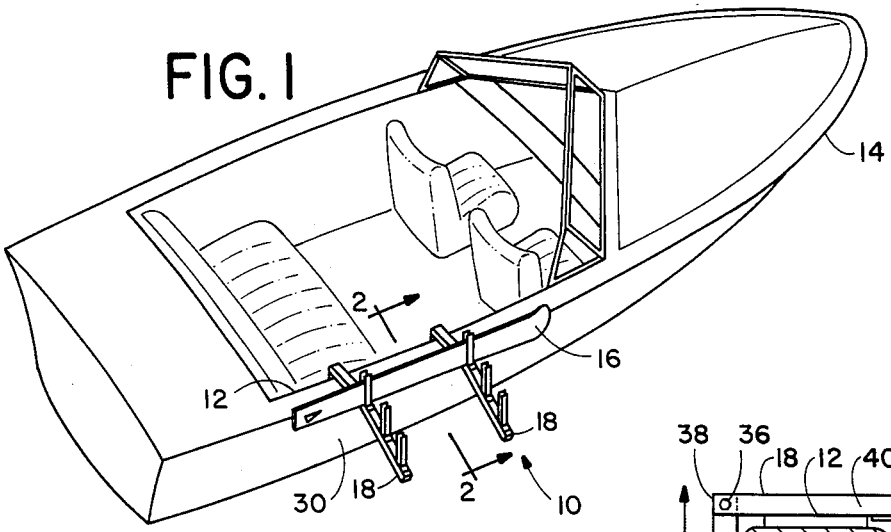
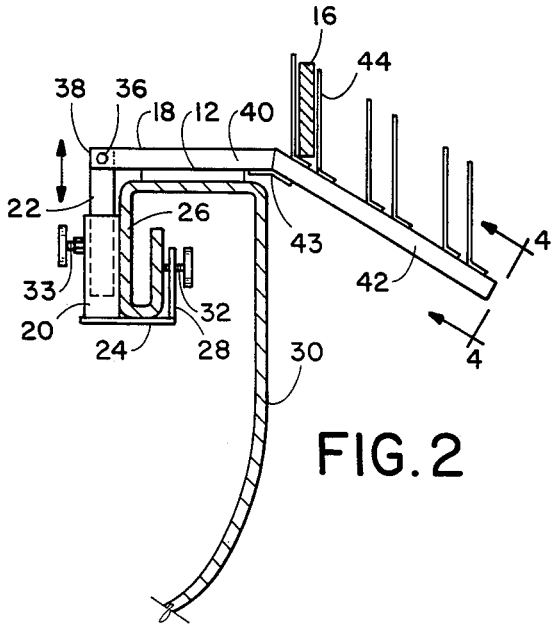
FIG. 2
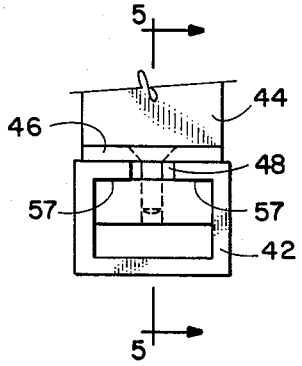
FIG. 4
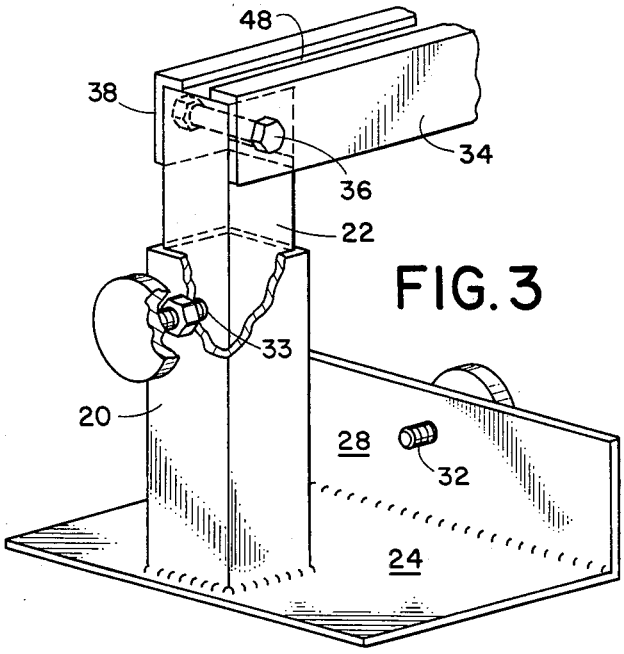
FIG. 3
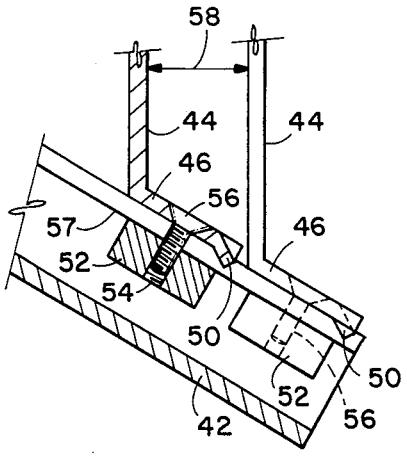
FIG. 5

WATER SKI RACK

BACKGROUND OF THE INVENTION

The present invention relates to improvements in ski racks, and particularly to a ski rack for attachment to the side of a water ski tow boat.

Small boats of 16 feet or less in length are frequently used as tow boats for water skiers. Free space within such boats is limited, yet room must be found for all of the people being carried in the boat, as well as any water skis which are not being used at a particular time. While skis can be kept within the boat, this presents the danger of damage to the skis and injury to the boat's passengers if the skis should move about while the boat is being operated. Therefore, ski racks of various types have been developed for stowage of water skis on boats, where they are available for use and not subject to damage or theft as a result of being left ashore at times when the boat is being operated other than for towing skiers.

Several ski racks have been previously patented, but each of them appears to have significant disadvantages for use with small water ski tow boats. For example, Carney U.S. Pat. No. 3,776,437, and Page U.S. Pat. No. 3,811,143 both disclose ski racks which hold water skis in locations within the hull of a skiing tow boat. Racks in such locations within the boat, however, tend to obscure the operator's view of skiers being towed by the boat, and take up room which is often at a premium within a water ski tow boat.

Shald, U.S. Pat. No. 4,232,806 discloses a ski rack which holds skis on a pair of laterally separated rearwardly extending bars. This arrangement, however, appears to present the likelihood of entanglement of a skiing tow rope on the rack. Additionally, the Shald ski rack includes a fixedly attached brace bar which cannot easily be removed from the boat.

Simmonds U.S. Pat. No. 3,925,836 disclosed a transom-mounted ski rack in which skis and the rack itself would appear to obstruct the boat operator's rearward field of vision.

Gallant U.S. Pat. No. 4,234,112 discloses a ski rack which is adaptable for boats of different sizes, but because of its attachment by the use of suction cups alone, the ski rack of the Gallant patent would not appear to provide a particularly secure stowage for water skis.

What is needed, then, is an easily installed ski rack for water skis which will hold water skis securely in a position outside the hull of a water ski tow boat, without obscuring the operator's view of water skiers being towed. Such a device should be able to be quickly removed from its installed position, and should permit water skis to be easily removed from the rack.

SUMMARY OF THE INVENTION

The present invention overcomes the previously mentioned disadvantages of previously-known racks for carrying water skis aboard water ski tow boats, by providing a ski rack which is easily installed to hold water skis outboard the hull of a tow boat, extending along side one side of the hull in a location where the skis are easily accessible by people in the boat, yet are not a hindrance or hazard to them. In the ski rack of the invention, clamps are provided on each of a pair of sockets to attach them to the side of the boat's hull, with the points of attachment preferably being inside the boat, beneath the gunwale on one side. A pair of support members are adjustably secured within the sockets and extend upwardly, thence horizontally across the top of the gunwale, and thence downward at an inclined attitude outboard the hull of the boat. Pairs of fingers are adjustably attached to the downwardly-sloping arms at locations which correspond between the two arms. The fingers extend generally vertically above the arms and are spaced apart from one another on each arm by a distance adequate to receive a water ski snugly between the fingers of each pair and hold it securely during operation of the boat. The portions of the ski rack with which the water skis might come into contact are preferably coated with a plastic coating, both to protect the finish of the skis and to provide some additional ability of the ski rack to securely hold the skis in position.

The position of each finger is made adjustable by clamping a base portion of the finger to the arm, using a bolt extending from the base of the finger through a slot in the top of the arm into a captive nut inside the arm.

It is therefore a principal object of the present invention to provide an improved, convenient, and inexpensive ski rack which will securely hold water skis in a safe location on a small water ski tow boat.

It is a further object of the present invention to provide a water ski rack which safely holds skis individually, protecting them from damage and preventing them from injuring passengers in the boat on which the ski rack is used.

It is a primary feature of the present invention that it includes a pair of easily installed sockets and individual supporting members easily installed in the sockets to hold ski-supporting arms of the rack in the proper locations for holding water skis.

It is another feature of the present invention that it provides a water ski rack including a pair of longitudinally separated downwardly and outwardly sloping arms having pairs of vertically oriented fingers adjustably located on each of the arms to hold individual water skis securely.

It is an important advantage of the present invention that it is more easily installed and removed than previously known water ski racks.

It is another advantage of the present invention that it is adjustable to hold individual skis in desired locations.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a perspective view of a water ski tow boat on which the ski rack embodying the present invention is installed.

FIG. 2 is a sectional view taken along line 2—2 of a portion of the boat shown in FIG. 1, showing one of the two separate units which make up the ski rack, at an enlarged scale.

FIG. 3 is a perspective view, partially cut away, of one of the clamps and a portion of the associated supporting member of the ski rack shown in FIG. 1.

FIG. 4 is an end view of the arm of the ski rack shown in FIG. 2, taken along line 4.4.

FIG. 5 is a sectional view of the portion of an arm of the ski rack shown in FIG. 4, taken along line 5—5.

DETAILED DESCRIPTION OF THE INVENTION

Referring now to the drawings, FIG. 1 shows a ski rack 10 embodying the present invention, in place on the starboard gunwale 12 of a boat 14. A water ski 16 is carried in the ski rack extending horizontally and longitudinally alongside the gunwale 12 of the boat 14. The ski rack 10 includes a pair of support members 18 each held removably in a socket 20, as shown in FIGS. 2 and 3.

Since both of the support members 18 and both of the sockets 20 are substantially identical, only one will be described. As shown in FIGS. 2 and 3, the support member 18 includes a vertical leg 22, which fits adjustably within the socket 20, which is preferably a length of square tubular metal, 1½ inches square and 6 inches long, for example. A horizontal base plate 24 is welded to the bottom of the socket 20 and extends generally horizontally beneath a downwardly extending portion 26 of the hull of the boat 14. Such a portion is commonly found, for example, in a fiberglass reenforced plastic hull. A clamp plate 28 is fixedly attached to the base plate 24 and extends substantially vertically upwardly between the downwardly extending portion 26 and the side 30 of the boat.

A clamp screw 32, preferably equipped with a knob or handwheel, extends through the clamp plate 28 in engagement with threads in the clamp plate 28, or a threaded nut (not shown) fastened to the clamp plate 28, so that the clamp screw 32 may be extended through the clamp plate 28 toward the downwardly extending portion 26 of the boat to fasten the socket 20 firmly to the downwardly extending portion 26 of the boat.

Similarly, a clamp screw 33 is threadedly engaged in the socket 20 to hold the vertical leg 22 in an appropriate position in the socket 20.

Fixedly attached to the vertical leg 22, at its upper end, is a horizontal section 34 of the support member 18, which may preferably be of channel stock having a rectangular cross section, including a slot extending along its top side. The inboard end 38 of the horizontal section 34 may be attached to the upper end of the vertical leg 22 by welding, or by a bolt 36, as shown in FIG. 2. In either case, the horizontal section 34 is intended to be fixedly attached at approximately a right angle to the vertical leg 22.

At the outboard end 40 of the horizontal section 34, an arm 42 extends downwardly at an angle of, for example, 45° below the horizontal, the horizontal section 34 and the arm 42 preferably being formed together by removing a V-shaped section from the bottom of the channel stock, which is then bent and welded at the outboard end 40 of the horizontal section 34. A reenforcing plate 43 may be used to provide additional strength at the joint.

Preferably, the horizontal section 34 is about 7 inches in length, so that it extends at least to the outer side of the gunwale 12. The arm 42 is preferably about 17 inches in length, giving ample room for placement of three pairs of fingers 44 which are adjustably fastened to the arm 42 at locations spaced along the length of the arm 42.

Each of the fingers 44 includes a base portion 46, shown more clearly in FIGS. 4 and 5, which extends along the upper surface of the arm 42. The fingers 44 extend generally vertically when the arm 42 is in its usual downwardly sloping position. Preferably, the fingers 44 are covered with a soft plastic coating which serves the dual purpose of protecting the water skis from being scratched by the surfaces of the metal fingers 44 and of resisting slippage of the water skis relative to the fingers 44 when the water ski 16 is located between the fingers 44.

The arm 42 is of rectangular U-shaped metal channel stock having three closed sides, and a centrally located slot 48 located in its top side extends along the length of the arm 42. Preferably, the base 46 of each finger 44 includes a central tab 50 which extends into the slot 48 to prevent the finger 44 from rotating.

A captive nut, preferably in the form of a rectangular block 52 having a threaded bore 54 therethrough, is located within the arm 42, the threaded bore 54 being exposed through the slot 48 to receive a clamp screw 56 (preferably a countersunk flathead screw) extending through the base 46 into the nut 52. The clamp screw 56 is tightened, holding the captive nut 52 against the inner surfaces 57 of the top side of the channel of the arm 42 to hold each of the fingers 44 in a desired location. The base 46 of each finger is short enough to permit the fingers 44 to be placed at intervals of about one inch, giving a minimum clearance 58 of about one inch or slightly less, in order to hold a water ski 16 securely between the fingers 44 of each pair.

The ski rack 10 of the present invention is mounted on a boat such as the boat 14 by fastening each of the sockels 20 to the boat in a convenient location, tightening the clamp screws 32 to bring the socket 20 snugly against the surface of the downwardly extending portion 26 of the boat below the gunwale 12, preferably placing the horizontal plate 24 in contact with the bottom of the downwardly extending portion 26, to provide stability. The sockets 20 should be separated longitudinally along the side of the boat 14 by a distance of about 2 feet, or as required to provide adequate clearance for the portions of the ski which receive the skier's foot during use of the skis.

Each of the support members 18 is installed by placing the vertical leg 22 in the socket 20 and lowering the support member 18 until the horizontal section 34 rests atop the gunwale 12 of the boat 14, giving support to the arms 42. The support member clamp screw 33 is then tightened to secure the vertical leg 22 within the socket 20. Water skis such as the ski 16 are then placed in the rack between the upright fingers 44 of corespondingpairs and are held there securely against bouncing out of the ski rack 10 by the snug fit and friction against the surfaces of the fingers 44. Nevertheless, the skis can be removed easily by being lifted vertically from their positions between the pairs of fingers 44. Should it become necessary to bring the side of the boat 14 on which the rack 10 is located alongside a dock, the support members 18 are easily removed from the sockets 20 by loosening the clamping screws 33 of the sockets 20, leaving the sockets in place in the boat while the support members 18 are removed. Both of the support members 18 may also be lifted simultaneously from the sockets 20 with the skis still in position between the pairs of fingers 44, in order to remove the skis and the rack quickly from their position outboard the hull of the boat 14.

Ordinarily, the ski rack 10 provides secure stowage for at least three water skis, holding them an ample distance above the surface of the water and keeping them from being obstructions within a boat. Thus, the ski rack 10 is useful for safely holding the skis and protecting them from damage which might occur if they were lying loose within a boat, and for protecting people within the boat from being injured by loose skis moving about within the boat.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A ski rack for attachment to the gunwale of a water ski tow boat for holding water skis in a safe and secure manner, comprising:

(a) a pair of sockets, each having attached thereto a clamp adapted for removably fastening the respective socket to a structural portion of a boat so that the socket is upwardly open, said clamp including a base plate attached to said socket and adapted to extend beneath a portion of the gunwale of a boat, a vertical plate adapted to extend upwardly between a portion of the side of said boat and a downwardly depending portion of said boat associated with said gunwale, and a clamp screw extending through said vertical plate;

(b) a pair of support members, each including a downwardly extending leg which fits within a respective one of said sockets, a horizontal section having an inboard end and an outboard end, said inboard end being attached fixedly to said leg, and a downwardly inclined arm attached fixedly to said outboard end; and (c) at least one pair of upwardly-extending fingers removably fastened to said arm of each of said support members at a selected location along said arm.

2. The ski rack of claim 1 wherein each arm comprises a U-shaped channel defining an upwardly-open slot extending along the arm, each finger including a base portion extending parallel with the respective arm, a clamp screw and a clamp nut, each finger being attached to the respective arm by said clamp screw extending through said base portion into said clamp nut, said clamp nut being captive within said channel and said clamp screw extending through the upwardly open slot portion of said channel.

3. The ski rack of claim 1 wherein said fingers are covered by a coating of a resilient plastic material.

4. The ski rack of claim 1, each said socket including clamping means for holding the respective leg at a selected height.

5. A ski rack for attachment to the gunwale of a water ski tow boat for holding water skis in a safe and secure manner, comprising:

(a) a pair of support members, each including a downwardly extending leg, a horizontal section having an inboard end and an outboard end, said inboard end being attached fixedly to said leg, and a downwardly inclined arm attached fixedly to said outboard end;

(b) at least one pair of upwardly-extending fingers removably fastened to the respective arm of each of said support members at a selected location along said arm, each finger of said pair being located on the respective arm at a location corresponding with the location of a finger on the arm of the other support member of said ski rack;

(c) upwardly open socket means for receiving each of said support members with the downwardly extending leg of the respective support member held therein;

(d) upwardly open clamp means, attached fixedly to said socket means, for removably attaching said socket means to a bottom edge of a gunwale portion of a boat inside an open portion of said boat; and (e) clamp screw means threadedly engaged with said upwardly open socket means for selectively holding each said leg at a predetermined position in a respective one of said socket means.

6. The ski rack of claim 5 wherein each arm comprises a U-shaped channel defining an upwardly-open slot extending along the arm, each finger including a base portion extending parallel with the respective arm, a clamp screw and a clamp nut, each finger being attached to the respective arm by said clamp screw extending through said base portion into said clamp nut, said clamp nut being captive within said channel and said clamp screw extending through the upwardly open slot portion of said channel.

7. The ski rack of claim 5 wherein said fingers are covered by a coating of a resilient plastic material.

* * * * *